US005328041A

United States Patent [19]

Hook et al.

[11] Patent Number: 5,328,041

[45] Date of Patent: Jul. 12, 1994

[54] TWO PIECE STOPPER FOR BLUNT FLUID CONNECTOR

[75] Inventors: William J. Hook, Gurnee; Mark E. Larkin, Lindenhurst, both of Ill.

[73] Assignee: Abbott Laboratories, Abbott Park, Ill.

[21] Appl. No.: 85,697

[22] Filed: Jun. 30, 1993

[51] Int. Cl.[5] ..... B65D 39/00; B65D 41/20

[52] U.S. Cl. ..... 215/247

[58] Field of Search ..... 215/247, 249, 364

[56] References Cited

U.S. PATENT DOCUMENTS 1,180,665 4/1916 McElroy ..... 215/247
4,366,912 1/1983 Matukura et al. ..... 215/247
4,954,149 9/1990 Fullemann ..... 215/247 X

*Primary Examiner*—Stephen P. Garbe
*Attorney, Agent, or Firm*—A. Nicholas Trausch

[57] ABSTRACT

A stopper assembly for sealing the open end of a container and usable with a blunt entry device includes an elastomeric stopper having an annular flange portion, a hollow plug portion, and a thin diaphragm portion, the flange portion covering and abutting the open end of the container, the plug portion depending from the inner circumference of the flange portion and sealingly engaging the interior of the open end of the container, and the diaphragm portion spanning the center portion of the annular flange portion. A metal ferrule for securing the stopper to the container has an annular top portion and an annular skirt portion for engagement with the exterior of the container.

8 Claims, 1 Drawing Sheet

TWO PIECE STOPPER FOR BLUNT FLUID CONNECTOR

FIELD OF THE INVENTION

The present invention relates generally to a stopper for use with a blunt fluid connector such as a blunt cannula and more particularly to a two piece, partially pre-pierced stopper enabling fluid connection by a blunt cannula without excessive force.

BACKGROUND OF THE INVENTION

Small elastomeric stoppers are commonly used to seal small volume medical containers such as glass unit dose vials. Due to the inherent resiliency of the elastomer, a sharp piercing device such as a needle or a cannula is used to penetrate the stopper to allow fluid communication from the sealed container. The solution or drug can then be transferred for administration to a patient or addition to another medical container.

The majority of stoppers currently in use are molded of medically suitable elastomeric compounds that allow entry by a sharp piercing device. These stoppers are configured so that the elastomeric material reseals when the sharp entry device is withdrawn. However, the thick diaphragm configuration of these conventional stoppers is not suitable for blunt connection devices. A blunt device would require excessive force to be applied to penetrate the thick diaphragm stoppers currently in use.

With increasing concern about diseases such as HIV and AIDS, the use of sharp entry devices in the health-care environment is being actively decreased. "Sharps" have the potential to accidentally breach the skin barrier by a "needle stick" and thereby transmit disease.

For fluid flow applications, such as for IV solution administration, a blunt cannula device, such as the Lifeshield® Blunt Cannula, can be used with a pre-pierced septum, such as the Lifeshield® Prepierced Reseal, both sold by Abbott Laboratories. However, the same pre-pierced construction used in pre-pierced reseals cannot be implemented for the stoppers on vials because of sterility and shelf-life degradation questions.

As an alternative to pre-pierced stoppers, there are known stopper constructions with thin diaphragm portions. However, these known thin diaphragm stoppers are typically special use stoppers and have inherent limitations for general use, such as expense, risk of contamination or lack of resealability, for example.

A stopper formed of a low tear-resistant rubber with a conical well in the top face that extends partway into the plug portion of the stopper is disclosed in U.S. Pat. No. 2,906,423 to Sandhage. The stopper also has a cut slit extending partway from the apex of the conical well towards the bottom face of the stopper. This construction provides a moisture proof closure as well as a closure that can be entered by forcing a blunt plastic needle therethrough. However, the stopper of Sandhage with the concavity and slit on the top or entry surface is difficult to swab with an antiseptic agent prior to entry and therefore increases the risk of introducing potential contaminants into the vial. Also the expense of manufacturing and maintaining quality control for the multiple steps in the molding, slitting and cleaning of the Sandhage stopper would be prohibitive for other than a special high cost vial.

The use of a transverse slot or multiple slots to thin a stopper diaphragm for entry by a blunt device such as a male luer connector is disclosed in U.S. Pat. No. 5,060,812 to Ogle. However the manufacturing and assembly processes are complex and thus expensive and the top concavity creates potential swabbing and contamination problems.

A stopper with a thin diaphragm portion including an indentation in the top surface is disclosed in U.S. Pat. No. 3,653,528 to Wimmer. This stopper also has swabbing problems and further would be difficult to reseal. Entry by a blunt device would tear the diaphragm along the conical wall portion and there would be little radial compressive forces to assist in resealing the diaphragm once the entry device is withdrawn.

Thus, it is an object of the present invention to provide a stopper assembly that is usable with blunt entry devices for sterile access to small volume vials or ports for flexible containers.

It is another object of the present invention to provide a stopper assembly which is economical to manufacture, assemble, sterilize and package.

Another object of the present invention is to provide a stopper which does not require excessive force by the user to insert a blunt entry device.

Another object of the present invention is to provide a stopper assemble for use by a blunt entry device which reseals after the entry device is withdrawn, thus potentially allowing for multiple entries.

These and other important objects will be apparent from the description of the present invention which follows.

SUMMARY OF THE INVENTION

The present invention relates to an improved stopper assembly for sealing a solution in an open-ended container which is usable with a blunt entry device. The stopper assembly includes an inner pre-pierced stopper member made of an elastomeric material, a thin diaphragm outer stopper member, and a metal ferrule with a removable cap for securing the inner and outer members of the stopper assembly together and also securing them both to the vial.

An embodiment of the stopper assembly that is usable with a blunt entry device includes an inner elastomeric stopper member having an annular flange portion, a hollow plug portion, a pre-pierced diaphragm portion and a first mating construction. The flange portion covers and abuts the open end of the vial. The plug portion depends from the inner circumference of the flange portion and sealingly engages the interior of the open end of the vial. The diaphragm portion is pre-pierced and spans the center portion of the annular flange portion. The inner stopper member also includes a mating construction that engages with the outer stopper member which includes a second mateable construction. The outer member also includes a thin diaphragm portion. A conventional ferrule member for securing the inner and outer stopper members together and to the container has an annular top portion holding a removable cap and an annular skirt portion for engagement with an exterior lip of the vial.

Other features and advantages of the present invention will become readily apparent from the following detailed description, the accompanying drawings, and the appended claims.

BRIEF DESCRIPTIONS OF THE DRAWINGS

DETAILED DESCRIPTION OF THE PREFERRED EMBODIMENTS

Figure 1:
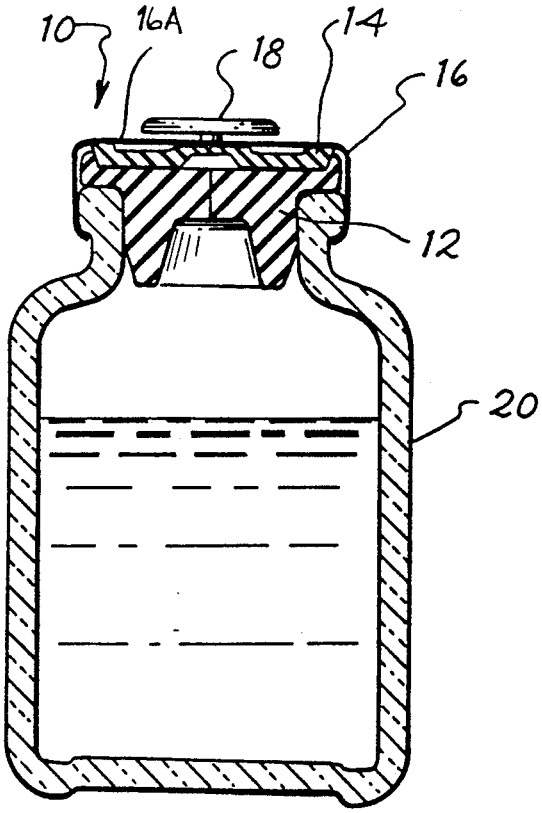
FIG. 1 is a cross-sectional view of a two-piece stopper assembly according to the present invention adapted for a standard flip top vial.

FIG. 1 shows a cross section of a stopper according to the preferred embodiment of the present invention in use with a conventional flip-top drug vial. The stopper assembly 10 includes an inner elastomeric stopper member 12, an outer stopper member 14, and a metal ferrule 16 including a standard flip top portion 18. The conventional vial 20 may be manufactured of glass or plastic, and ranges in size from 2 ml to 100 ml.

Figure 2:
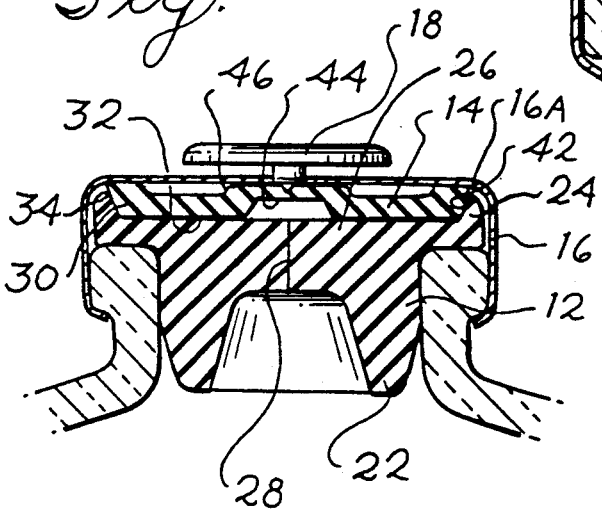
FIG. 2 is an enlarged cross-sectional view of the stopper assembly according to the present invention.

Referring now to FIG. 2, the stopper assembly according to the present invention will be described. The inner stopper member 12 is made of a moldable elastomeric compound that is compatible with the solution or drug to be contained. The inner stopper member includes a plug portion 22 which is received and sealed in the open end of the container or vial 20. An annular flange portion 24 covers the container or vial opening. By convention, a 13 mm diameter stopper is used to seal small vials such as 2, 5, 10, and 20 ml. Alternatively, a 20 mm diameter stopper is used to seal larger volumes such as 50, 100 and 250 ml.

The annular flange portion 24 surrounds a pre-pierced diaphragm portion 26 which spans and closes the hollow plug portion 22. The diaphragm portion is pierced along 28 prior to assembly. It is preferable that the inner stopper member 12 be molded from a stiff elastomer so as to obtain the best resealing along the pre-pierce 28.

The top surface 30 of the inner stopper member 12 includes a circular relief area 32 having a conically inclined wall 34. The conical wall 34 is truncated by a shallow bottom surface 36.

An outer stopper member 38 is manufactured in the shape of a thin disc member. The outer circumference of the disc is sized and conically tapered along wall 42 to complement the inclined wall 34 of the inner stopper member 12. With the complementary tapered fit, the inner 12 and outer 14 stopper members can be manufactured and assembled without rigid tolerance. The two inclined walls will mate as long as the inclines of the two walls are generally inverse. An incline angle between two mating parts is an easier tolerance to control than the diameter of two parts sealingly fitting together.

As best seen in FIG. 2, the outer stopper member 14 further includes a set off 44 from the inner stopper surface immediately above the pre-pierced slit 28. The set off area is designated on the top surface of the outer stopper member 14 as the "target" area by a raised ring 46. The outer stopper member is preferably molded from a soft elastomer.

The two elastomeric stopper members 12 and 14 are primarily held in mating and sealing contact along the abutting inclined walls 34 and 42 by the ferrule 16 including an annular, inwardly extending radial flange portion 16A having an appropriately sized center opening. When the ferrule is applied and rolled-over, the axially compressive force of the radial flange portion 16A of the ferrule is directed to the outer stopper member 14 and then to the inner stopper member 12. The primary seal of the stopper assembly is at this interface between the two inclined walls.

The elastomeric parts of this stopper assembly may be readily moldable in large batch quantities. The preferred construction of FIG. 2 for example, allows single step molding of large quantities of both inner and outer stopper members for economical manufacture.

Figure 3:
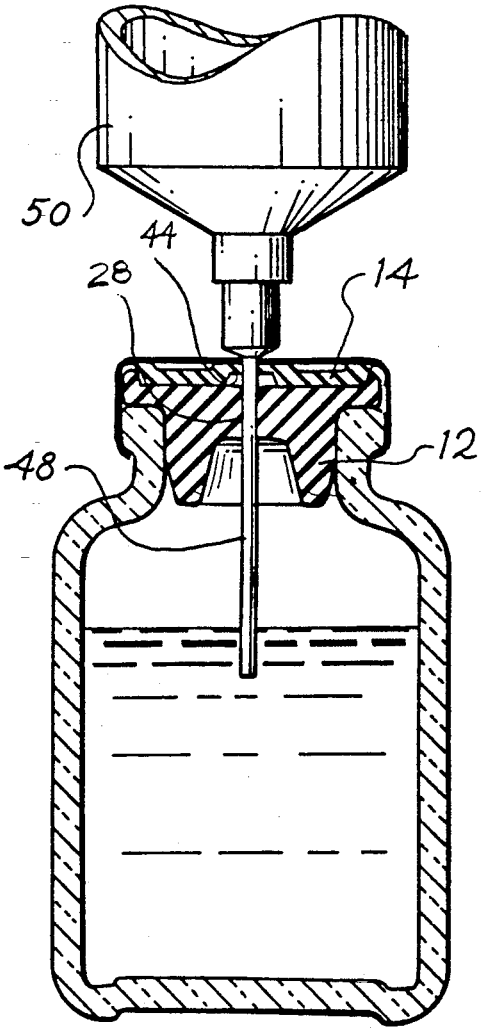
FIG. 3 is a cross-sectional view of the stopper assembly according to the present invention during fluid transfer by a blunt cannula syringe.

Referring now to FIG. 3, the stopper assembly 12 and 14 according to the present invention will now be described in connection with a blunt cannula device 48 such as a Lifeshield® Blunt Cannula. In FIG. 3 the cannula rips through the set off 44 or the extra thin diaphragm portion of the outer stopper member 14 and then passes through the pre-pierced slit 28 in the inner stopper member. When the cannula is withdrawn from the stopper assembly, the two members reseal, thus potentially allowing multiple withdraws from the same vial.

Figure 4:
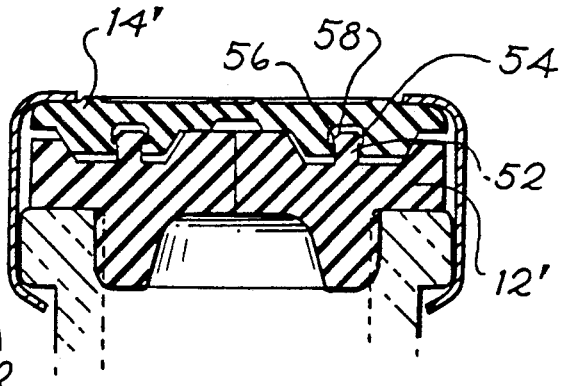
FIG. 4 is a cross-sectional view of an alternate embodiment of a two piece stopper assembly according to the present invention.

Referring now to FIG. 4, a further embodiment of a two-piece stopper is shown. In this embodiment an axially extending annular flange formed a latching ring 52 is provided on the inner stopper member 12 and a mating groove 54 is provided on the outer member. Under cuts 56 and overcuts 58 can be added to the ring 52 and groove 54 respectively to improve the snap together assembly.

The present invention provides the advantage of a thin diaphragm accessible with a blunt entry device while also providing a smooth surface for swabbing and the construction provides avoidance of a wrinkled tampered appearance by having robust resistance to application forces during assembly.

The stopper members of the present invention are moldable of an elastomeric material in large batch quantities in a single step process. Thus manufacturing and assembly of the two-piece stopper is not complex or costly.

It is understood that the above descriptions are made only by way of example and are not intended to limit the scope of the invention. Many variations and modifications can be carried out without departing from the spirit of the invention. For example, the latches could be on the outer member while the grooves could be on the inner member. Accordingly, the claims are not intended to be limited by the above specific embodiment.

What is claimed is:

1. A two-piece stopper assembly constructed and arranged to seal an open end of a container, the stopper assembly comprising:

an inner elastomeric stopper member having a radially outward extending annular flange portion, an axially inward extending hollow plug portion, and a radially inward extending pre-pierced diaphragm portion, the radially extending annular flange portion constructed and arranged to axially abut the open end of the container, the axially extending plug portion depending from the annular flange portion and constructed and arranged to sealingly engage the interior of the open end of the container, and the pre-pierced diaphragm portion constructed and arranged to close the center opening of the annular flange portion;

an outer stopper member having a center target area having a reduced diaphragm thickness, and means for sealingly securing the outer stopper member to the inner stopper member.

2. The stopper assembly of claim 1 wherein the means for securing the outer stopper member to the inner stopper member is an annular ferrule having a radially inward extending flange that overlaps the inner and outer stopper member.

3. The stopper assembly of claim 2 further including a first mating means wherein the first mating means is a circular surface relief area having a conically inclined wall in the inner stopper member having a truncated conical side wall.

4. The stopper assembly of claim 3 further including a second mating means wherein the second mating means has the shape of a thin circular disc having a truncated side wall.

5. The stopper assembly of claim 4 wherein the inner stopper member further includes an axially outward extending annular flange, the flange having overcut latches at the outward end.

6. The stopper assembly of claim 5 wherein the outer stopper member further includes an axially inward indented annular groove, the groove having undercut sockets at the inward end.

7. The stopper assembly of claim 6 wherein the flange and the groove are matably aligned so that the overcut latches and undercut sockets have a snap fit.

8. The stopper assembly of claim 1 wherein the outer stopper is molded of an elastomer material.

* * * * *